US005685503A

United States Patent [19]

Trouillot et al.

[11] Patent Number: 5,685,503

[45] Date of Patent: Nov. 11, 1997

[54] DEPLOYMENT DEVICE FOR THE FIN OF A PROJECTILE

[75] Inventors: Christian Trouillot, Sainte Thorette; Alain Verstraete, Villeneuve sur Cher, both of France

[73] Assignee: Luchaire Defense AS, Versailles, France

[21] Appl. No.: 481,038

[22] Filed: Jun. 23, 1995

[30] Foreign Application Priority Data

Jun. 28, 1994 [FR] France ..... 94 07953

[51] Int. Cl.[6] ..... F42B 10/14

[52] U.S. Cl. ..... 244/3.28; 244/3.27; 244/3.3

[58] Field of Search ..... 244/3.24, 3.25, 244/3.27, 3.28, 3.29, 3.3, 3.26

[56] References Cited

U.S. PATENT DOCUMENTS

| | | | |
|---|---|---|---|
| 2,427,217 | 9/1947 | Lebhertz et al. | 244/3.28 |
| 2,666,387 | 1/1954 | Richey et al. . | |
| 3,053,184 | 9/1962 | Francois | 244/3.28 |
| 3,188,957 | 6/1965 | Petre | 244/3.27 |
| 3,845,922 | 11/1974 | Mayer | 244/3.28 |
| 3,861,627 | 1/1975 | Schoffl | 244/3.27 |
| 3,944,168 | 3/1976 | Bizien et al. | 244/3.28 |
| 4,143,838 | 3/1979 | Holladay | 244/3.28 |
| 4,158,447 | 6/1979 | Humphries et al. | 244/3.27 |
| 4,332,360 | 6/1982 | Topliffe | 244/3.27 |
| 4,641,802 | 2/1987 | Zalmon et al. | 244/3.28 |
| 4,667,899 | 5/1987 | Wedertz | 244/49 |
| 4,702,436 | 10/1987 | Arnell | 244/328 |
| 5,078,337 | 1/1992 | Waller | 244/3.28 |

FOREIGN PATENT DOCUMENTS

| | | | |
|---|---|---|---|
| 2070389 | 9/1971 | France . | |
| 2721536 | 11/1978 | Germany | 244/3.28 |
| 2115117 | 9/1983 | United Kingdom . | |
| 2136930 | 9/1984 | United Kingdom . | |

*Primary Examiner*—Michael J. Carone
*Assistant Examiner*—Christopher K. Montgomery
*Attorney, Agent, or Firm*—Oliff & Berridge

[57] ABSTRACT

A deployment device for stabilizing fins of a projectile includes at least one pallet and a holding device for each fin. The pallet is oriented to receive an aerodynamic flow when the projectile is fired and thus transfers a resultant strain to the fin to deploy it away from the projectile. The deployment device can be used for fins of a projectile fired from smooth barrelled weapons.

20 Claims, 6 Drawing Sheets

DEPLOYMENT DEVICE FOR THE FIN OF A PROJECTILE

BACKGROUND OF THE INVENTION

The subject of the present invention is that of a device to deploy the stabilizing fins of a projectile, notably of a projectile fired from a recoilless gun.

Certain projectiles, and notably those fired from a smooth barrel such as that of a recoilless gun, comprise stabilizing fins on their rear part. These fins are folded up when the projectile is in the launch tube and they spread out upon exit from the latter.

Known deployment devices more often than not employ springs which are held in a tensed position when the fins are folded along the body of the projectile and which are released thereby deploying the fin upon exit from the launch tube.

Patent FR7803397 describes such a deployment device

The disadvantage of such devices is that they require several springs to be held in a tensed position (one per fin) throughout the storage life of the projectile.

The mechanical qualities of the springs deteriorate over time resulting, on the one hand, in a reduction in deployment efficiency, and on the other, in dissymmetries when the fins are opened which prejudice the stabilization of the projectile on its trajectory and therefore also prejudice firing accuracy.

Moreover, the installation of springs implies the fitting of suitable housings for them in the projectile body. This causes problems during assembly and inspection thereby increasing production costs.

SUMMARY OF THE INVENTION

One aim of the invention is to propose a deployment device for the stabilizing fins of the projectile which does not present such disadvantages whilst ensuring the efficient and symmetrical deployment of the stabilizing fins and this at a reduced cost.

The subject of the invention is thus a deployment device for the stabilizing fins of a projectile which is characterised in that it comprises at least one pallet, made integral with a fin by driving structure, and facing such that it receives an aerodynamic flow when the projectile is fired thereby transferring a resultant strain to the fin in order to deploy it.

Such a device avoids having to use elastic static energy stored in the springs in order to open the fins.

A further advantage of this device is that it allows maximum force to be exerted at the beginning of opening, when the resistant strains are also greater.

According to another characteristic of the invention, the driving structure of each fin is unlockable such as to be able to separate the deployment device and the fin from a certain opening angle of the latter. Any residual aerodynamic drag caused by the device is thus avoided. By releasing the fins early enough, any rebound of the latter is also avoided.

According to a first embodiment, the device may comprise at least two pallets separated by a groove in which the fin is positioned, the groove having a bottom against which the fin comes to bear when it is in its folded position along the projectile body and which constitutes the driving structure.

According to one particularity of this embodiment, the device may comprise a front wall closing the groove at the front part of the device which forms an axial stop for the end of the fin.

According to another particularity of this embodiment, the device may comprise at least two lateral support feet which are in contact with an outer surface of the projectile and which are held in place by stop profiles carried by the projectile and arranged so as to prevent any movement of the device in a perpendicular direction to a lateral surface of the fin.

According to a second embodiment, the device may comprise at least one pallet integral with at least two lateral drive surfaces, each of these drive surfaces being designed to provide a bearing surface for a different fin of the projectile when the fins are in their folded position along the projectile body.

According to one particularity of this embodiment, the device may comprise a tab designed to come to hear on a flange integral with the projectile and which forms an axial stop for the device.

According to an alternative, the device may comprise at least one wall which is roughly perpendicular to each drive surface forming an axial stop of the end of the fin in question.

According to another particularity of this embodiment, each lateral drive surface may comprise a holding area for a first lateral surface of the fin.

According to another characteristic, the device may comprise an external guiding surface having a circular profile and of which the diameter is equal to that of the launch tube for the projectile.

BRIEF DESCRIPTION OF THE DRAWINGS

Other advantages of the invention will become apparent after reading the following description of the different embodiments, a description made with reference to the appended drawings wherein.

DETAILED DESCRIPTION OF PREFERRED EMBODIMENTS

Figure 1:
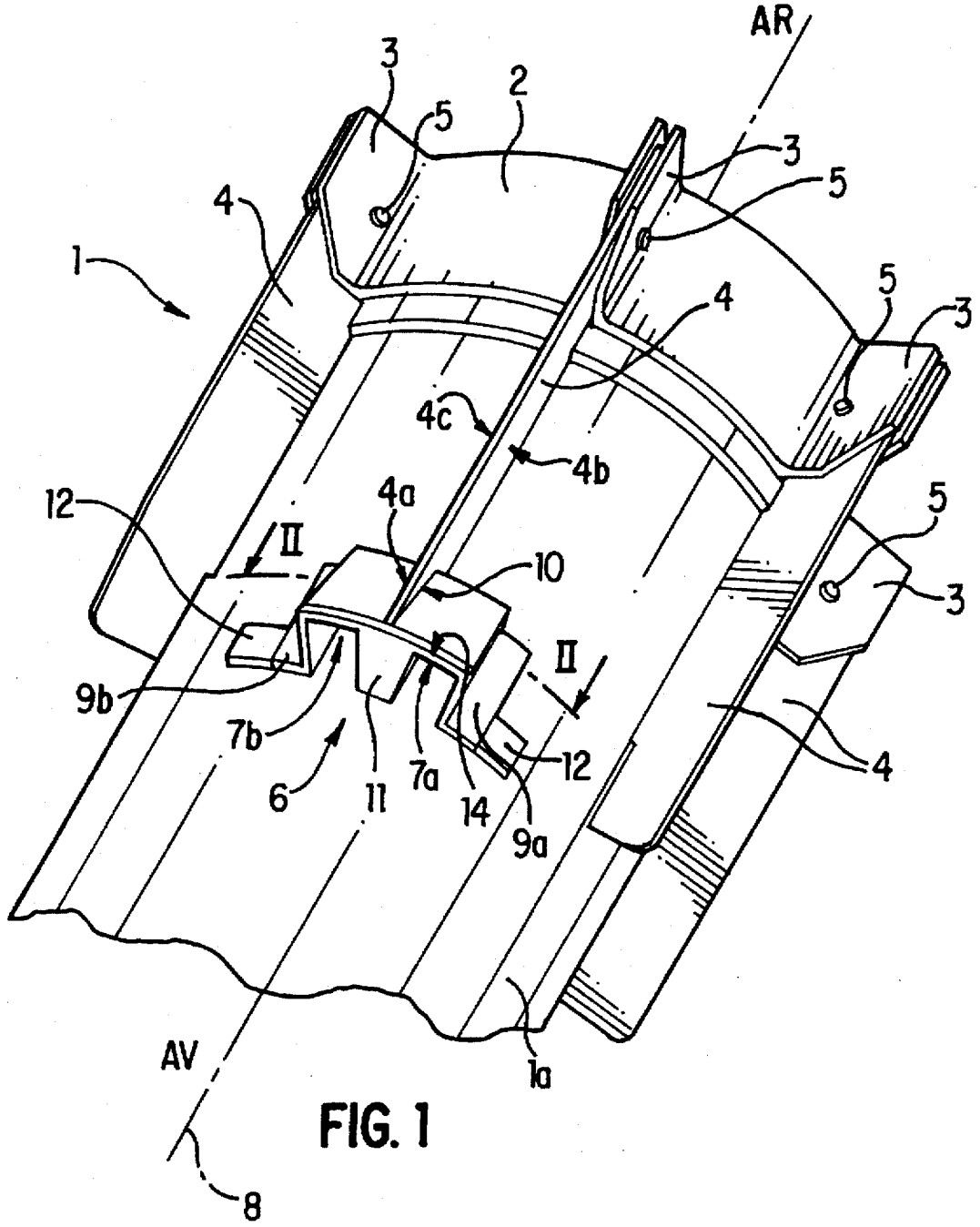
FIG. 1 partly shows the rear part of a projectile fitted with a fin deployment device according to a first embodiment of the invention.

FIG. 1 shows a top view of the rear part of a projectile1 designed to be fired from a recoilless launch tube of a known type (not shown).

This rear part comprises a flange 2 on which fork joints 3 evenly distributed at an angle are arranged. Each fork joint accommodates a fin 4, mounted swivelling around an axis 5.

Figure 2:
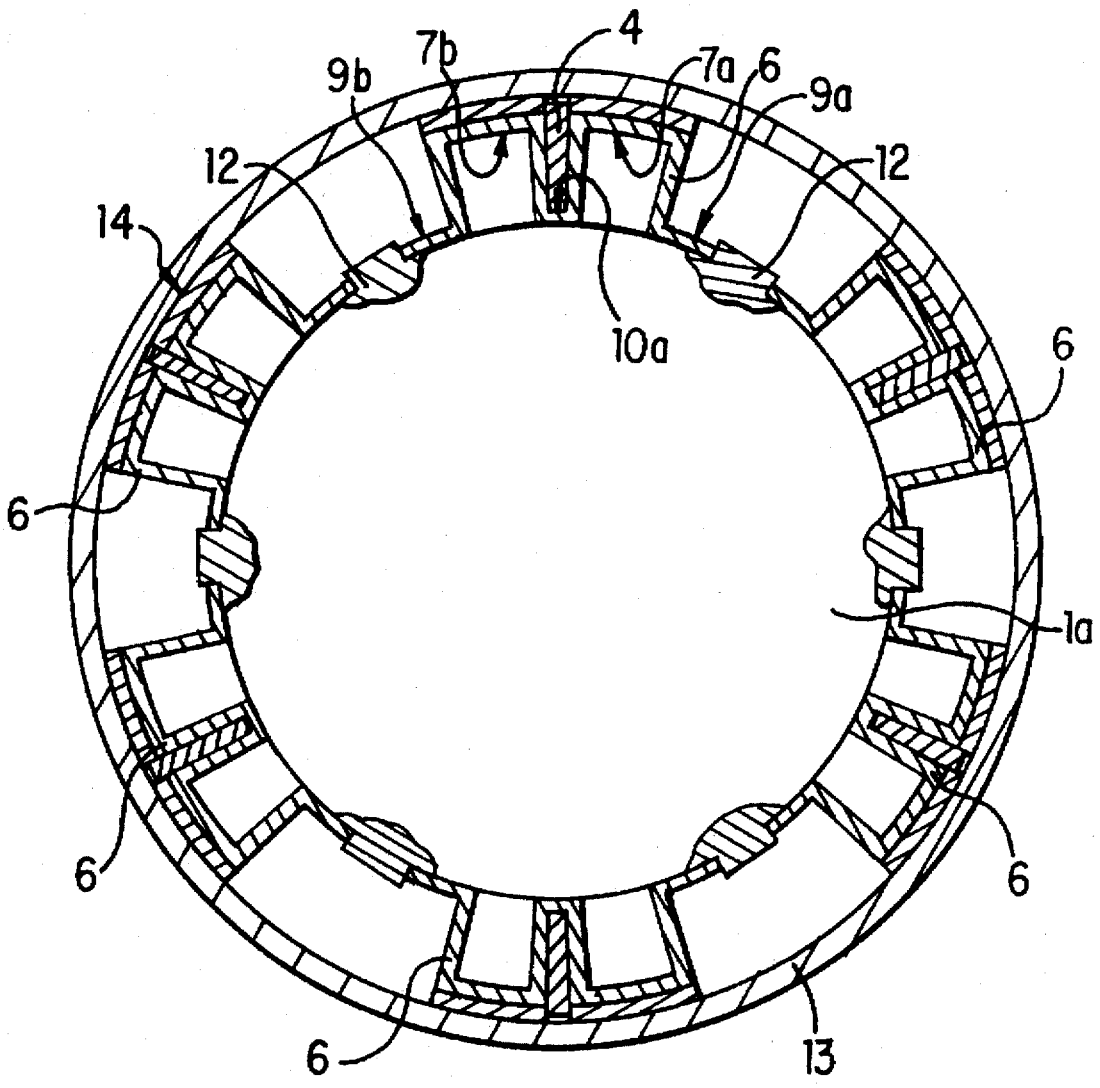
FIG. 2 is a transverse cross-section of the rear part of this projectile level with the fin deployment devices, along the plane marked II on FIG. 1.

The projectile thus shown carries six fins 4 evenly distributed (see FIG. 2).

The fins 4 are shown here in their folded position along the body of the projectile 1, a position which they adopt inside the launch tube.

Each fin 4 has, on a front end 4*a*, a deployment device 6 according to the invention (here a single device is shown so as not to overcomplicate the figure).

According to a first embodiment described, the device 6 comprises two pallets 7*a* and 7*b* which receive the aerodynamic flow which appears along the projectile body after firing between the front part (marked AV) and the rear part (marked AR).

These pallets are roughly shaped like two planes slanted with respect to the axis 8 of the projectile and perpendicular to the lateral surfaces 4*b* and 4*c* of the fin 4.

The slant of the pallets with respect to the axis 8 of the projectile is chosen such that the aerodynamic flow acts upon the device 6 to move it away from the body of the projectile.

Thus because of the mode of operation employed, the device according to the invention may only be used to deploy fins which in their starting position are folded along the body of the projectile, the free ends of the fins facing the front part of the projectile and the fork joints being arranged to the rear of the latter.

Figure 3A:
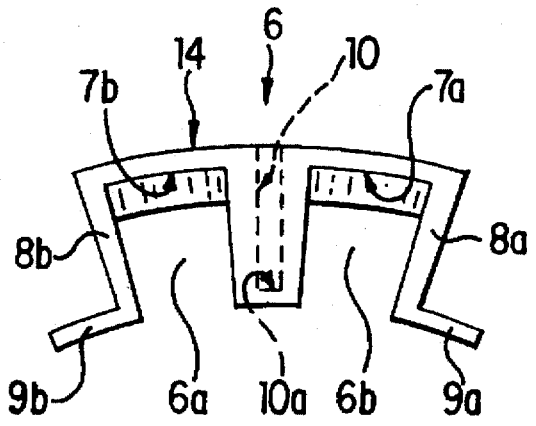
FIGS. 3*a*, 3*b* and 3*c* show this first fin deployment device according to three orthogonal views.
Figure 3C:
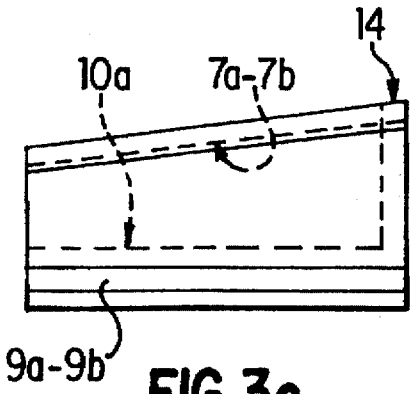
Figure 3B:
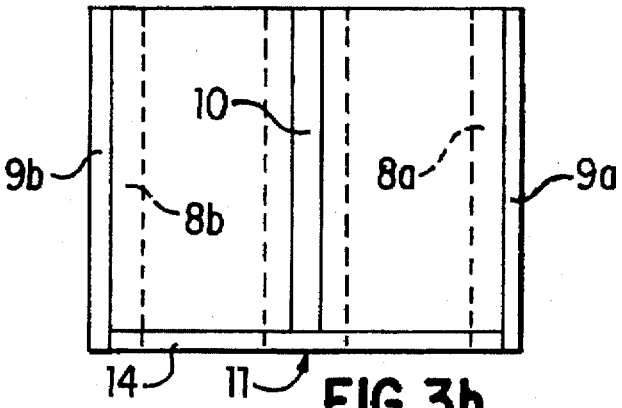

FIGS. 3*a*, 3*b* and 3*c* show the deployment device 6 in detail.

This device is made, for example, of a molded plastic material (such as high density polyethylene or polyamide). The thickness of the material is more or less the same for the whole of the device. The pallets 7*a* and 7*b* are connected to lateral walls 8*a* and 8*b* which are finished off by lateral support feet 9*a* and 9*b*.

The lateral walls 8*a*, 8*b* are plane end are roughly parallel to the lateral surfaces 4*b*, 4*c* of the fin 4.

The device, after being positioned on the projectile, are formed so as to present two channels 6*a*, 6*b* in face of the aerodynamic flow wherein the inlet apertures (arranged towards the front part AV of the projectile) have a greater surface area than the outlet apertures (facing the rear part AR), and this because of the slanting of the pallet.

The support feet 9*a*, 9*b* are designed to come into contact with the outer surface of the body 1*a* of the projectile, they therefore have a cylindrical profile having a diameter which is equal to that of the body 1*a* of the projectile.

The two pallets 7*a* and 7*b* are separated by a groove 10 in which the fin 4 is positioned.

The groove 10 has a bottom 10*a* against which the fin comes to bear when it is in its folded position along the body of the projectile.

The groove 10 is closed off by a front wall 11 on a front part of the device 6. When the device 6 is positioned on the projectile, the end 4*a* of the fin is axially stopped against the wall 11. The fin thus balances the inertial strains to which the pallet is subjected during firing.

The width of the groove 10 will be chosen such that there is no give when the device 6 is positioned on the fin.

Furthermore, the feet 9*a* and 9*b* of the device are held laterally by stop profiles 12 carried on the projectile. These profiles 12 are arranged such that they prevent any movement of the device in a perpendicular direction to the lateral surfaces 4*b*, 4*c* of the fin 4.

As an alternative, the stop profiles 12 could also act as axial stops for the device, in this case a nick would merely have to be made on each foot preventing the device from moving backwards.

Immobilizing the device, on the one hand with respect to the fin and on the other with respect to the body of the projectile, the fin is prevented from bending during its passage inside the launch tube thereby avoiding vibrations at the end of the fin upon exit from the tube and improving the deployment process and the stabilizing of the projectile.

FIG. 2 shows a cross-section along plane II—II in FIG. 1 of the projectile 1 positioned in a launch tube 13.

As is apparent from this figure, the device 6 has an outer guiding surface 14 wherein the diameter is equal to that of the launch tube 13. The device thereby improves the guiding of the projectile in the launch tube.

The device operates as follows.

When a projectile is fired the fins are firmly held in place by the device throughout their passage through the launch tube.

Upon exit from the tube the aerodynamic flow penetrates in the apertures 6*a* and 6*b* and exerts a strain upon the pallets 7*a* and 7*b*. This strain pushes the devices 6 away from the body 1*a* of the projectile which results in the fins 4 being driven by means of the bottom 10*a* of the grooves 10 and the wall 11.

All the fins open symmetrically and this mainly because, thanks to the device according to the invention, the strain applied to the fin is of an aerodynamic nature being greater at the beginning of the opening process. The absence of vibrations of the fin obtained by means of the transverse wedging due to the stop profiles 12 also promotes symmetry.

The device according to the invention thus avoids the problems encountered in using known deployment springs whereof the mechanical qualities are likely to deteriorate throughout the storage life of the projectile.

Beyond a certain angle of deployment, the resultant of the aerodynamic strains as well as the centrifugal force exerted on the device 6 overcome the friction between the fin and the groove 10 and lead to the separation of the device and the fin.

Thus during deployment, the devices are automatically ejected and do not perturb the flight of the projectile by causing aerodynamic drag.

It is possible to determine the angle of opening of the fin from which the device is elected by adjusting the dimensions of the fin/groove contact surfaces (for example by giving the groove a shape which is not parallel to the lateral faces of the fin).

It is also possible to determine the angle at which the ejection of the device is produced by adjusting the position of the front wall 11 and/or the shape of the end of the fin.

In this event, the action of the centrifugal force is combined with the twisting torque of the device with respect to the fin which is generated by the aerodynamic forces.

Figure 4:
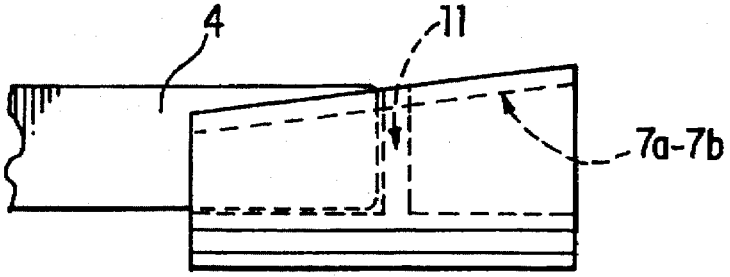
FIG. 4 show an alternative embodiment of the device.

FIG. 4 thus shows by way of illustration a device wherein the bottom 11 is set back with respect to the inlet apertures of the channels 6*a*, 6*b*.

Figure 5:
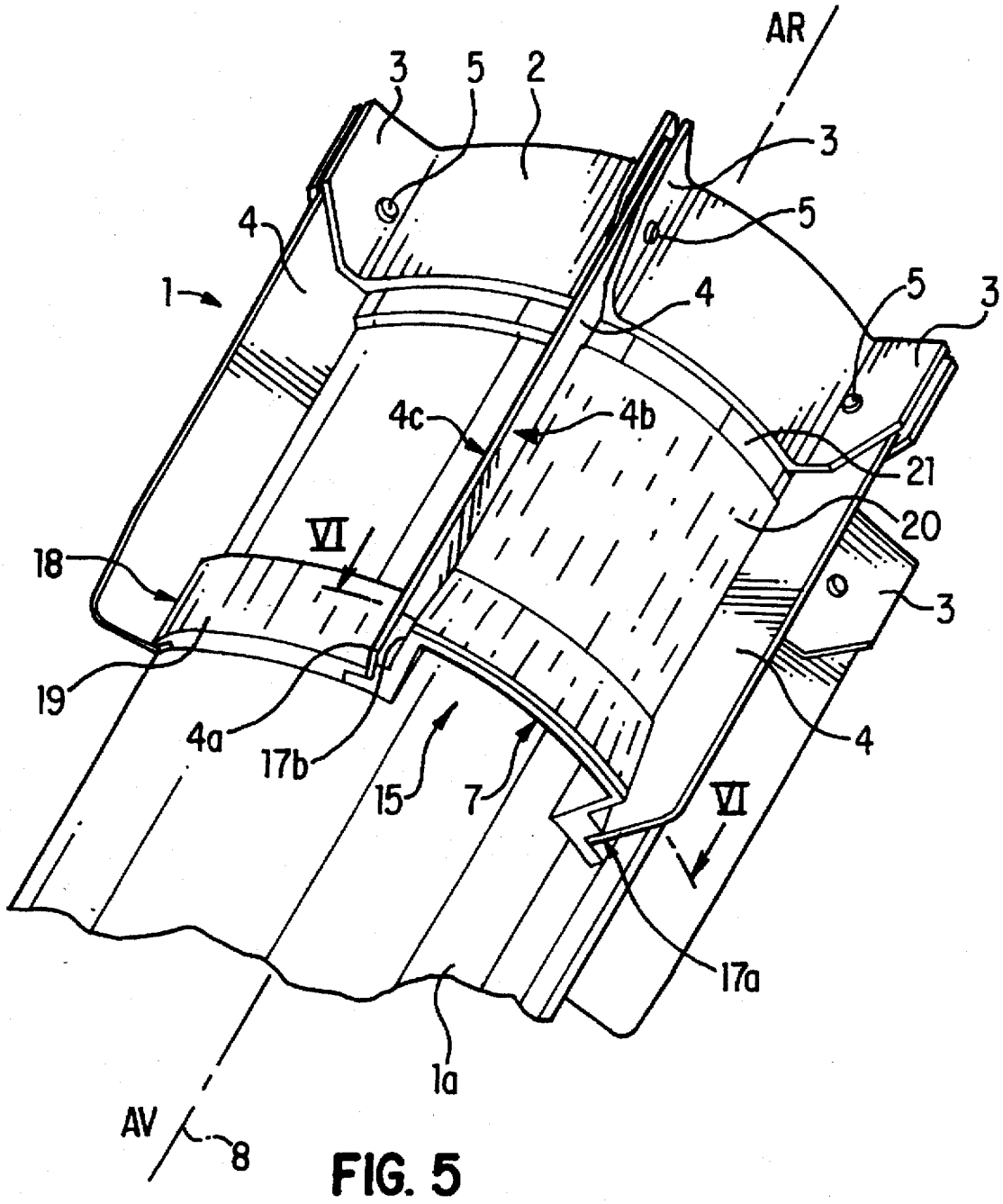
FIG. 5 partly shows the rear part of a projectile fitted with a fin deployment device according to a second embodiment of the invention.

FIG. 5 is a top view of the rear part of a projectile 1 fitted with a deployment device 15 according to a second embodiment of the invention which is designed for projectiles fitted with an even number of fins.

This device comprises a pallet 7 designed to receive the aerodynamic flow which appears along the body 1*a* of the projectile upon firing between the front part (marked AV) and the rear part (marked AR).

The slant of the pallet with respect to the axis 8 of the projectile is once again chosen such that the aerodynamic flow acts to push the device 15 away from the body of the projectile.

Figure 7A:
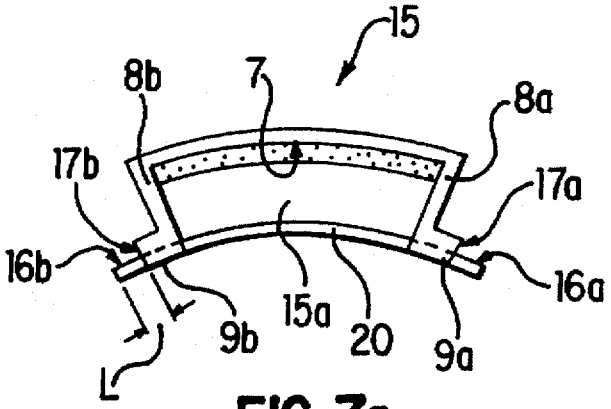
FIGS. 7*a*, 7*b* and 7*c* show this second fin deployment device according to three orthogonal views.
Figure 7B:
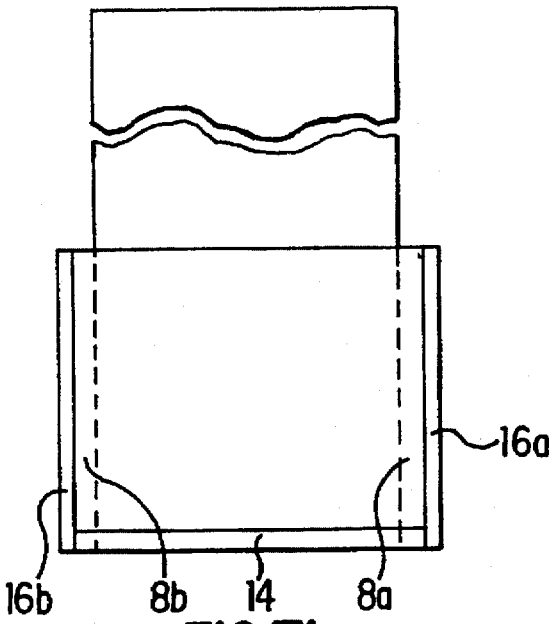
Figure 7C:
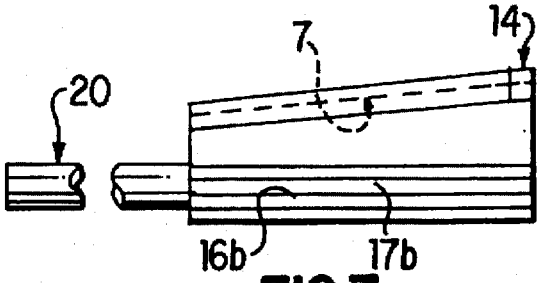

FIGS. 7*a*, 7*b* and 7*c* show this deployment device in detail.

This is also preferably made of a molded plastic material.

The pallet 7 is connected to the lateral walls 8*a* and 8*b* which are finished off by lateral support feet 9*a* and 9*b*. As in the previous embodiment, the lateral walls 8*a*, 8*b* are plane and are roughly parallel to the lateral surfaces 4*b*, 4*c* of the fin 4.

Thus the device, after being positioned on the projectile, is formed so as to present, opposite the aerodynamic flow, a channel 15*a* wherein the inlet aperture (arranged towards the front par AV of the projectile) has a greater surface area than the outlet aperture (facing the rear part AR).

The support feet 9*a*, 9*b* come into contact with the outer surface of the body 1*a* of the projectile, they have a cylindrical profile of a diameter equal to that of this body.

Each has a lateral drive surface 16*a*, 16*b* which is designed to bear a fin 4.

Each surface 16*a*, 16*b* thus accommodates a different fin when the latter are in their folded position along the body 1*a* of the projectile.

The feet 9*a*, 9*b* also carry holding areas 17*a*, 17*b* which are each in contact with a lateral surface of the fin in question.

Figure 6:
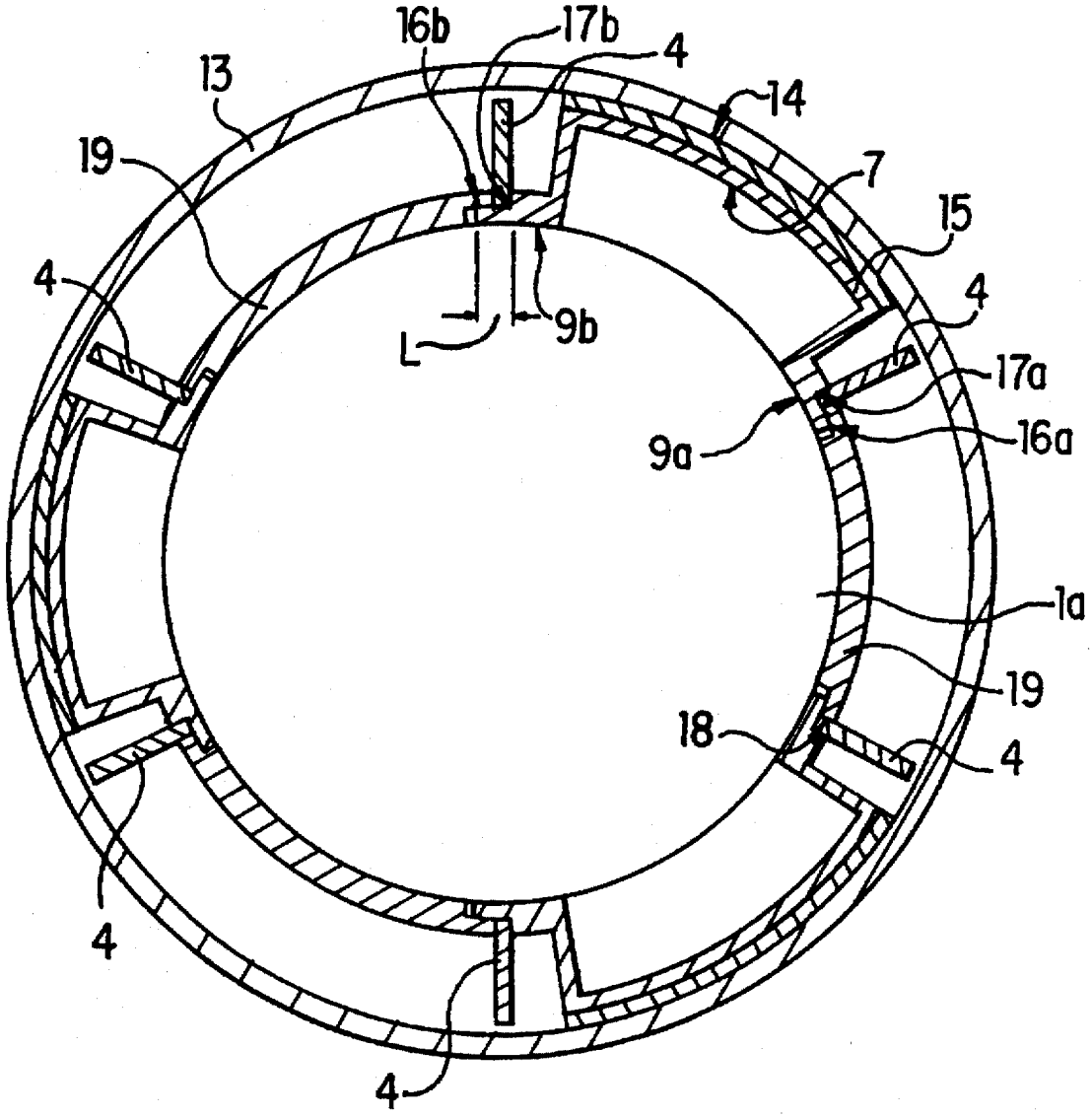
FIG. 6 is a transverse cross-section of the rear part of the projectile level with the fin deployment devices, alone the plane marked BB on FIG. 5.

As may be seen more clearly from FIG. 6, three devices 15 according to the invention enable six fins to be deployed.

Each fin is held lateral on one side by a holding area 17 carried by one of the devices 15 and on the other side by a stop profile 18 integral with a collar 19 also made of a plastic material and made integral with the body of the projectile, for example by bonding.

As may be seen from FIG. 5, the collars are axially offset with respect to the device, this in order that the collars do not prevent the fin from opening.

The dimensions of the devices 15 and the collars 19 are chosen such that there is no give when the fin is positioned.

Such an arrangement enables the ends of the fins to be immobilized thereby avoiding vibrations upon firing and improving the deployment process and the stabilization of the projectile.

It would nevertheless be possible to omit the collars 19 and to keep only a unilateral hold of the fin by the holding area 17, the result thereby obtained would however be less efficient.

Each device 15 lastly comprises a rear tab 20 which is designed to come to bear on a flange 21 of the projectile constituting an axial stop for the device.

The tab also enables the pivotal point of the device, on the rear flange and at an equal distance from each fin, to be located. Such an arrangement ensures the symmetrical opening of the two fins by the device.

It would be possible, as an alternative, to replace this tab by two walls, each one carried by a foot 9*a*, 9*b* and perpendicular to the drive surface 16*a*, 16*b* in question. These walls come to stop against end 4*a* of the fin during assembly.

As in the above alternative, the device 15 comprises an outer guiding surface 14 wherein the diameter is equal to that of the launch tube 13. The device thereby improves the guiding of the projectile in the launch tube.

This embodiment of the invention operates is a similar way to the previous embodiment.

The deployment device is also ejected from a certain angle of opening of the fins.

An advantage of this embodiment is in that it enables the device to be ejected very quickly which reduces the latter's action to a simple initial impetus on the fins which then finishes opening through inertia and under the effect of their own drag.

The quick ejection of the device has the added advantage of limiting the angular speed of the fin at the end of its course of movement thereby limiting rebound of the fin and improving the stabilization of the projectile.

In fact, the distance between the ends of two neighboring fins increases during opening. The fins are therefore rapidly freed from the drive surfaces 16*a*, 16*b* and notably by adjusting the length L (see FIGS. 6 and 7*a*).

A further advantage of this embodiment is in that it enables the number of devices used for a projective to be reduced, which in turn reduces the cost of manufacture.

Lastly, by way of an alternative, it would be possible to design a deployment device which would remain integral with the fin even after deployment. Such a device would comprise, for example, one or several pallets fastened to the side walls of each fin.

We claim:

1. A deployment device for deploying at least one foldable stabilizing fin of a projectile that moves from a folded position to an unfolded position as the projectile moves in a projection direction, said deployment device comprising at least one rigid pallet disposed adjacent a periphery of the projectile and means attached thereto for contacting and releasably holding the at least one rigid pallet to a forward-most end with respect to the projection direction of at least one folded fin until said at least one rigid pallet receives an aerodynamic flow when the projectile is fired, to thereby move the at least one fin from the folded position to the unfolded position.

2. A device according to claim 1, wherein the holding means is unlockable from the projectile so as to separate the deployment device from the fin during a predetermined angle of opening of the fin.

3. A device according to claim 1, wherein said at least one rigid pallet comprises at least two rigid pallets separated by a groove, which comprises the holding means and in which the fin is positioned, the groove having bottom in which the fin is positioned when the fin is in the folded position, said bottom comprising at least a portion of said holding means.

4. A device according to claim 3, wherein a front wall closes the groove at a front part of the deployment device, said front wall comprising an axial stop for an end of the fin.

5. A device according to claim 1, wherein said deployment device includes at least two lateral support feet that contact an outer surface of the projectile and that are held by stop profiles supported by the projectile, said stop profiles being arranged to prevent movement of the deployment device in a direction perpendicular to a lateral surface of the fin.

6. A device according to claim 1, wherein said means for holding includes at least two lateral drive surfaces, each of the lateral drive surfaces accommodating a fin of the projective when each fin is in the folded position.

7. A device according to claim 6, further comprising a tab bearing on a flange that is integral with the projectile, said tab comprising an axial stop for the deployment device.

8. A device according to claim 6, further comprising at least one wall that is substantially perpendicular to each of said lateral drive surfaces, said at least one wall comprising an axial stop for an end of a respective fin.

9. A device according to claim 6, wherein each lateral drive surface includes a holding area for a lateral surface of each fin.

10. A device according to claim 1, further comprising an outer guiding surface having a circular profile and a diameter equal to that of a launch tube of the projectile.

11. A deployment device for deploying at least one foldable stabilizing fin of a projectile that moves from a folded position to an unfolded position as the projectile moves in a projection direction, said deployment device comprising at least one rigid pallet disposed adjacent a periphery of the projectile and a holding device cooperable with and attached to the pallet, said holding device contacting and releasably holding said at least one rigid pallet to a forwardmost end with respect to the projection direction of at least one folded fin until the at least one rigid pallet receives an aerodynamic flow when the projectile is fired, to thereby move the at least one fin from the folded position to the unfolded position.

12. A device according to claim 11, wherein the holding device is releasable from the projectile so as to separate the deployment device from the fin during a predetermined angle of opening of the fin.

13. A device according to claim 11, wherein said at least one rigid pallet comprises at least two rigid pallets separated by a groove, which comprises the holding device and in which the fin is positioned, the groove having a bottom in which the fin is position when the fin is in the folded position, said bottom comprising at least a portion of said holding device.

14. A device according to claim 13, wherein a front wall closes the groove at a front part of the deployment device, said front wall comprising an axial stop for an end of the fin.

15. A device according to claim 11, wherein said deployment device rigid includes at least two lateral support feet that contact with an outer surface of the projectile and that are held by stop profiles supported by the projectile, said stop profiles being arranged to prevent movement of the deployment device in a direction perpendicular to a lateral surface of the fin.

16. A device according to claim 11, wherein said holding device includes at least two lateral drive surfaces, each of the lateral drive surfaces accommodating a fin of the projectile when each fin is in the folded position.

17. A device according to claim 16, further comprising a tab bearing on a flange that is integral with the projectile, said tab comprising an axial stop for the deployment device.

18. A device according to claim 16, further comprising at least one wall that is substantially perpendicular to each of said lateral drive surfaces, said at least one wall comprising an axial stop for an end of a respective fin.

19. A device according to claim 16, wherein each lateral drive surface includes a holding area for a lateral surface of each fin.

20. A method for deploying at least one foldable stabilizing fin of a projectile from a folded position to an unfolded position as the projectile moves in a projection direction, said method comprising:

releasably connecting the forwardmost end with respect to the projection direction of the at least one fin when in the folded position to at least one rigid pallet that is adjacent to a periphery of said projectile; and positioning a surface of the at least one rigid pallet such that said at least one rigid pallet receives an aerodynamic flow when the projectile is fired, to thereby move the at least one stabilizing fin from the folded position to the unfolded position.

* * * * *